US006729752B2

(12) United States Patent
Nakata

(10) Patent No.: US 6,729,752 B2
(45) Date of Patent: May 4, 2004

(54) HEADLAMP

(75) Inventor: Yutaka Nakata, Isehara (JP)

(73) Assignee: Ichikoh Industries, Ltd., Tokyo (JP)

( * ) Notice: Subject to any disclaimer, the term of this patent is extended or adjusted under 35 U.S.C. 154(b) by 6 days.

(21) Appl. No.: 10/263,475

(22) Filed: Oct. 3, 2002

(65) Prior Publication Data

US 2003/0076689 A1 Apr. 24, 2003

(30) Foreign Application Priority Data

Oct. 5, 2001 (JP) ..... 2001-310758

(51) Int. Cl.[7] ..... F21W 101/02

(52) U.S. Cl. ..... 362/517; 362/518; 362/297; 362/346

(58) Field of Search ..... 362/517, 518, 362/516, 297, 346

(56) References Cited

U.S. PATENT DOCUMENTS 4,254,456 A * 3/1981 Grindle et al. ..... 362/300
6,382,822 B1 * 5/2002 Maekawa et al. ..... 362/522
6,471,383 B1 * 10/2002 Oyama et al. ..... 362/517
6,626,565 B2 * 9/2003 Ishida ..... 362/514

FOREIGN PATENT DOCUMENTS

JP 10-003806 A 1/1998
JP 2001-176310 A 6/2001

* cited by examiner

*Primary Examiner*—Laura K. Tso
(74) *Attorney, Agent, or Firm*—Foley & Lardner

(57) ABSTRACT

Since sub-reflectors are built on left and right of a longitudinal main reflector, respectively, a headlamp can be made compact longitudinally if viewed from the front. By making the headlamp compact longitudinally if viewed from the front, the sub-reflectors are provided longitudinally, i.e., provided to be elongated vertically. Therefore, luminous intensity distribution patterns diffused downward can be obtained.

21 Claims, 13 Drawing Sheets

HEADLAMP

BACKGROUND OF THE INVENTION

1) Field of the Invention

The present invention relates to a headlamp which can obtain a predetermined luminous intensity distribution pattern (e.g., a luminous intensity distribution pattern for a dipped beam) and predetermined diffusion type luminous intensity distribution pattern located on the right and left of this predetermined luminous intensity distribution pattern (e.g., cornering luminous intensity distribution pattern), respectively.

2) Description of the Related Art

As a headlamp made longitudinally compact if viewed from the front, there is known, for example, a headlamp disclosed in Japanese Patent Application Laid-Open No. 2001-176310. Although this conventional headlamp can obtain a predetermined luminous intensity distribution pattern for a dipped beam, it cannot obtain diffusion type luminous intensity distribution patterns on the right and left of this predetermined luminous intensity distribution pattern, respectively, e.g., cornering luminous intensity distribution patterns.

In addition, as a headlamp which can obtain a luminous intensity distribution pattern for a fog lamp and cornering luminous intensity distribution patterns located on the right and left of this fog lamp luminous intensity distribution pattern, respectively, there is known, for example, a headlamp disclosed in Japanese Patent Application Laid-Open No. 10-3806. However, this conventional headlamp is long sideways and not made longitudinally compact if viewed from the front. Further, since this conventional headlamp is long sideways if viewed from the front, it is possible to obtain cornering luminous intensity distribution patterns diffused right and left relatively easily but it is relatively difficult to obtain a luminous intensity distribution pattern diffused downward.

SUMMARY OF THE INVENTION

It is an object of this invention to provide a headlamp which can be made longitudinally compact if viewed from the front and which can obtain a luminous intensity distribution pattern diffused downward by being made longitudinally compact if viewed from the front.

According to one aspect of this invention, in order to achieve the above object, there is provided a headlamp which comprises: a main reflector which has a light axis, sub-reflectors built on left and right of this main reflector, respectively, and a light source which is arranged on the light axis. The main reflector has a longitudinal structure which has such a width near the light axis as to be able to obtain a highest light intensity and such a height as to be able to obtain the predetermined luminous intensity distribution pattern, if viewed from the front. The sub-reflectors have vertical wall structures which obtain predetermined diffusion type luminous intensity distribution patterns on the left and right of the predetermined luminous intensity distribution pattern, respectively.

As a result, according to the above aspect, if the light source is turned on, the light from the light source is reflected by the main reflector and the predetermined luminous intensity distribution pattern having the highest light intensity is obtained. In addition, the light from the light source is reflected by the sub-reflectors and the predetermined diffusion type luminous intensity distribution patterns are obtained on the left and right of the predetermined luminous intensity distribution patter, respectively.

As can be seen, according to the above aspect, since the sub-reflectors are built on the left and right of the longitudinal main reflector, respectively, the headlamp can be made compact longitudinally if viewed from the front. In addition, according to this aspect, by making the headlamp compact longitudinally if viewed from the front, the sub-reflectors are provided longitudinally, i.e., provided to be elongated vertically and luminous intensity distribution patterns diffused downward are, therefore, obtained.

These and other objects, features and advantages of the present invention are specifically set forth in or will become apparent from the following detailed descriptions of the invention when read in conjunction with the accompanying drawings.

DETAILED DESCRIPTION

Figure 1:
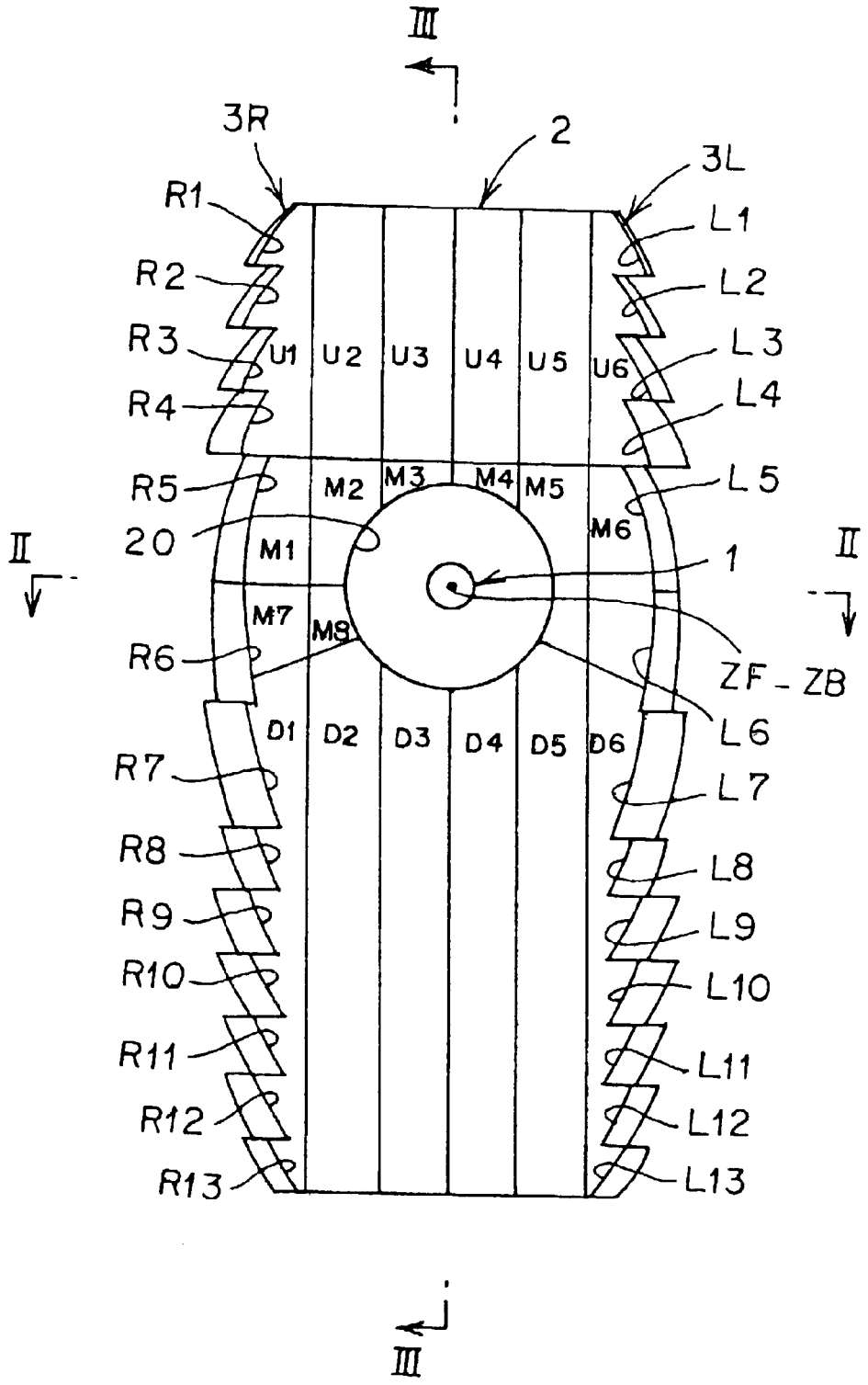
FIG. 1 is a schematic front view of a main reflector, a left sub-reflector and a right sub-reflector which shows one example of one embodiment of a headlamp according to this invention.

This invention relates to a headlamp which can be made compact longitudinally if viewed from the front and can obtain a diffusion type luminous intensity distribution pattern diffused downward (i.e., a luminous intensity distribution pattern for illuminating the front road surface and the like relative to a vehicle traveling direction) by being made longitudinally compact if viewed from the front. It is noted that "road surface and the like" means a road surface, a person (e.g., a pedestrian) and an object (the other vehicle, a traffic sign, a building or the like) on the road surface.

One embodiment of a headlamp according to this invention will be explained hereinafter with reference to the accompanying drawings. It is noted that this invention is not limited by this embodiment. In addition, the headlamp in this embodiment is attached to a left-hand drive vehicle. Therefore, a headlamp attached to a right-hand drive vehicle is reversed from right to left. In this embodiment, a predetermined luminous intensity distribution pattern obtained by a main reflector is a luminous intensity distribution pattern for a dipped beam, and a predetermined diffusion type luminous intensity distribution pattern obtained by each sub-reflector is a luminous intensity distribution pattern for cornering.

In the drawings, symbol "F" denotes the traveling direction of a vehicle and forward of a driver. Symbol "B" denotes an opposite direction to the vehicle traveling direction and rearward of the driver. Symbol "U" denotes an upper side relative to the driver. Symbol "D" denotes a down side relative to the driver. Symbol "L" denotes a left side relative to the front of the driver. Symbol "R" denotes a right side relative to the front of the driver. Symbol "Z—Z" denotes a light axis (a pseudo light axis). Symbol "H—H" denotes a horizontal line (horizontal axis). Symbol "V—V" denotes a vertical line (vertical axis). Symbol "ZF-ZB" denotes the front-to-rear light axis or the light axis. Symbol "HL-HR" denotes a left-to-right horizontal line. Symbol "VU-VD" denotes an upper-to-lower vertical line.

The headlamp in this embodiment includes a light source 1, a main reflector 2, a left sub-reflector 3L and a right sub-reflector 3R.

Figure 3:
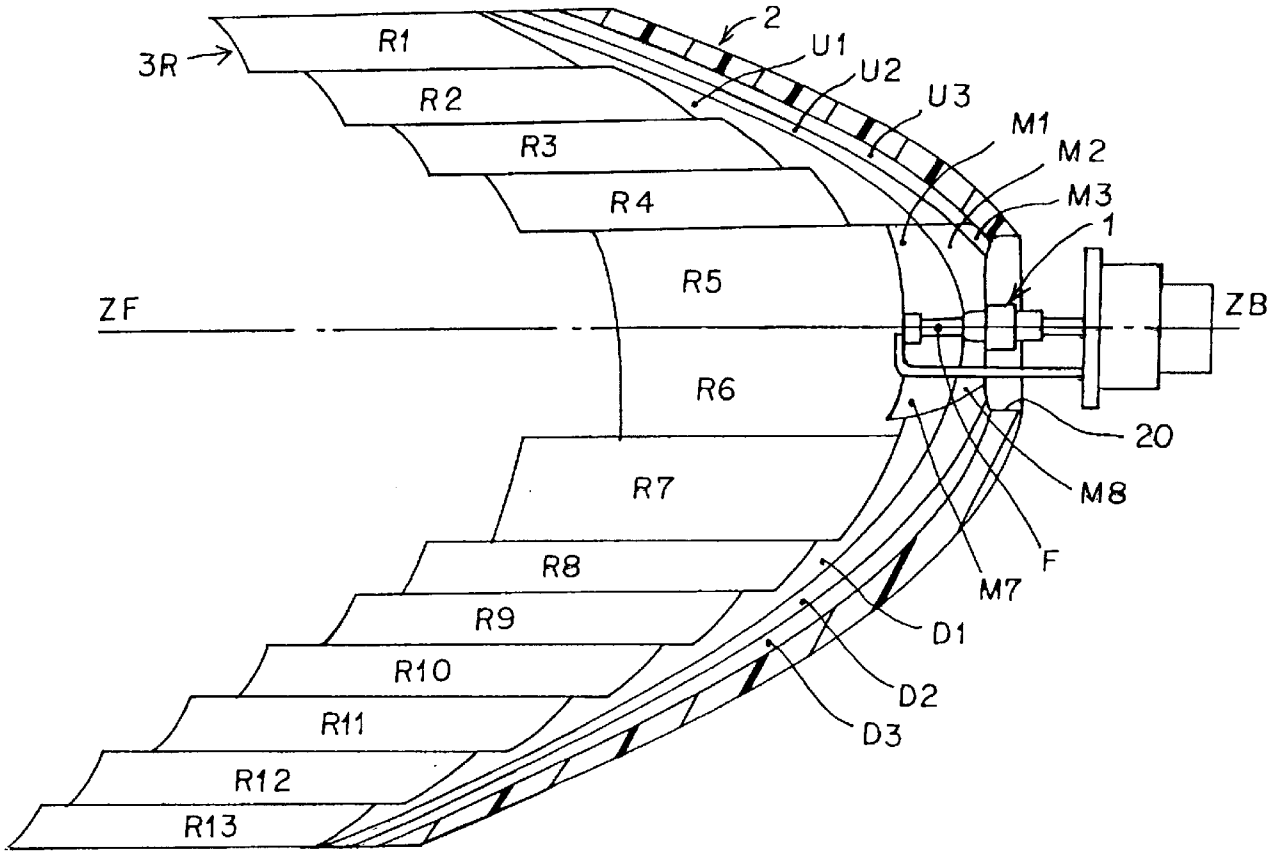
FIG. 3 is a cross-sectional view taken along line III—III of FIG. 1.

A discharge lamp (high-pressure metal steam discharge lamp such as metal halide lamp, high intensity discharge lamp (HID) or the like) is employed as the light source 1. As shown in FIGS. 1 and 3, the discharge lamp 1 is arranged to be detachable on the light axis ZF-ZB of the main reflector 2. The light emitter (not shown) of the discharge lamp 1 is arranged near a focus (pseudo-focus) F of the main reflector 2.

The main reflector 2 is a fixed reflector and obtains a predetermined luminous intensity distribution pattern for a dipped beam. The light axis ZF-ZB is present almost at the center of the main reflector 2. A circular transparent hole 20 about this light axis ZF-ZB is provided in the main reflector 2. The discharge lamp 1 is arranged at a predetermined position through the transparent hole 20. By so arranging, the light axis ZF-ZB and the discharge lamp 1 are located almost at the central portion of the main reflector 2.

As shown in FIG. 1, if viewed from the front, the main reflector 2 has a longitudinal structure (a longitudinal, generally rectangular structure) with such a horizontal width of, for example, about 70 to 100 mm, preferably about 80 mm near the light axis ZF-ZB as to be able to obtain the highest light intensity pattern and with such a vertical height as to be able to obtain the predetermined luminous intensity distribution pattern for a dipped beam. In addition, as shown in FIG. 3, the upper and lower portions of the main reflector 2 are protruded forward. This structure enables the main reflector 2 to effectively reflect a light beam from the discharge lamp 1.

Figure 4:
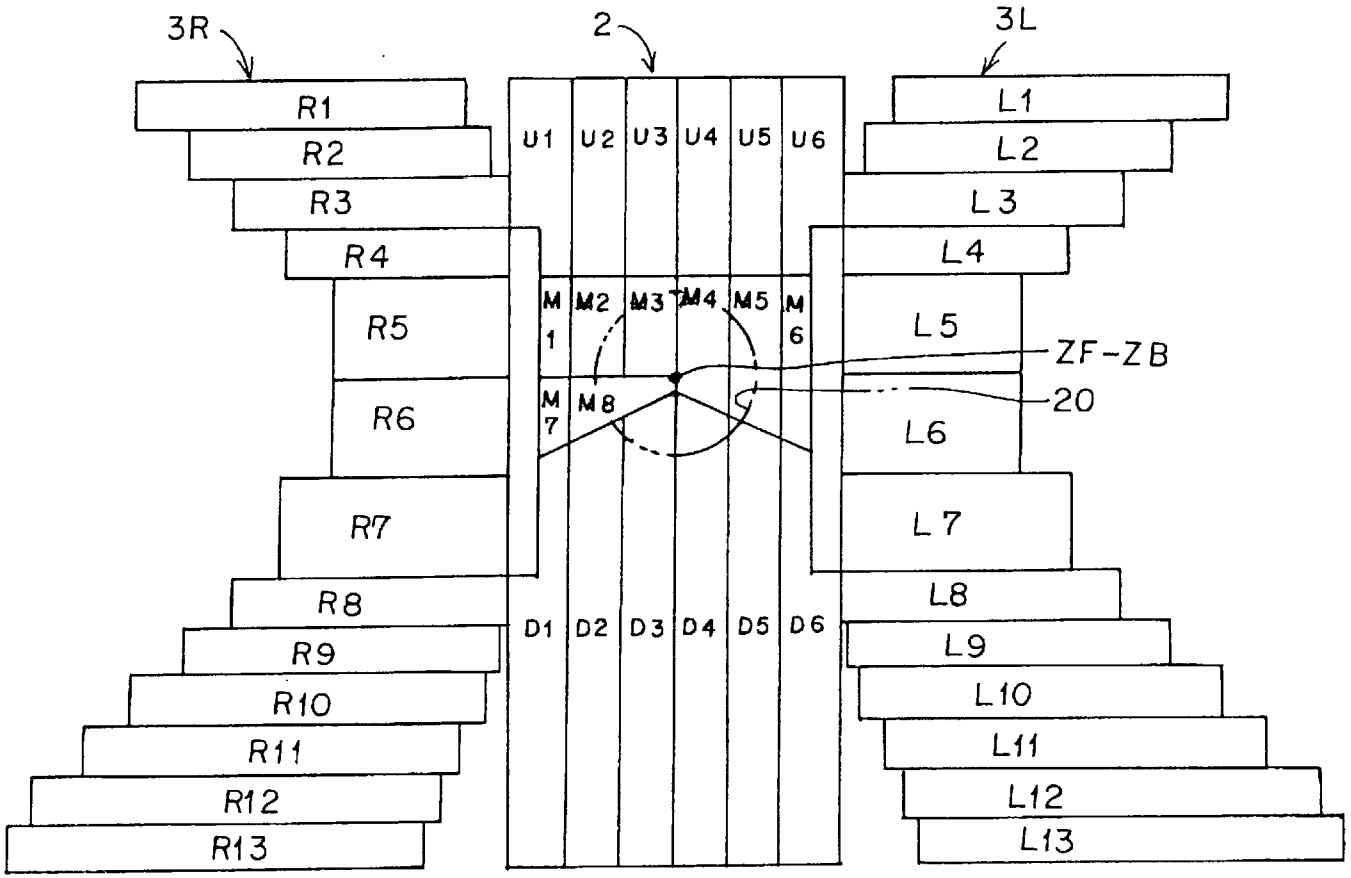
FIG. 4 is a development view which shows respective segments of the main reflector, those of the left sub-reflector and those of the right sub-reflector and which is a combination of an IVR arrow-direction view, an IVC arrow-direction view and an IVL arrow-direction view of FIG. 2.

The main reflector 2 mainly consists of a plurality of longitudinal segments divided laterally. In this embodiment, as shown in FIGS. 1 and 4, the main reflector 2 is divided into three to four segments (upper segment, middle segment (a part of which is further divided into upper and lower segments) and lower segment) vertically and into six segments laterally. Namely, the main reflector 2 consists of six upper longitudinal segments U1, U2, U3, U4, U5 and U6, eight middle longitudinal segments M1, M2, M3, M4, M5, M6, M7 and M8, and six lower longitudinal segments D1, D2, D3, D4, D5 and D6.

As shown in FIGS. 22 to 41, the main reflector 2 consists of reflection surfaces which are included in luminous intensity distribution patterns obtained from the neighborhood of the light axis ZF-ZB to the lower end, i.e., obtained in the lower segments D1 to D6 (see FIGS. 36 to 41), those obtained from the upper end to the neighborhood of the light axis ZF-ZB, i.e., obtained in the upper segments U1 to U6 (see FIGS. 22 to 27) and those obtained in the middle segments M1 to M8 (see FIGS. 28 to 35) respectively.

Figure 5:
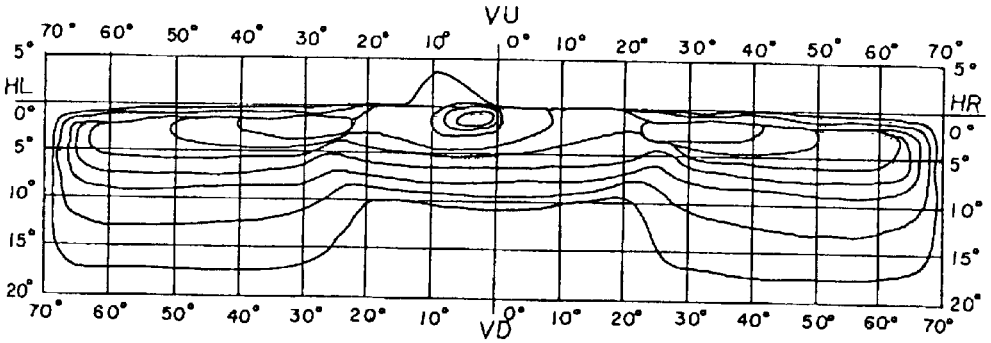
FIG. 5 is an image view which shows a luminous intensity distribution pattern obtained by combining a luminous intensity distribution pattern for a dipped beam with left and right cornering luminous intensity distribution patterns and irradiated on a screen.
Figure 7:
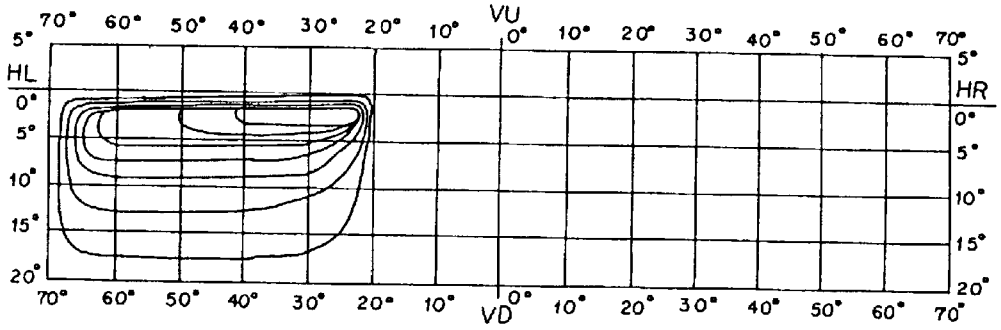
FIG. 7 is an image view which shows the left cornering luminous intensity distribution pattern irradiated on the screen.
Figure 8:
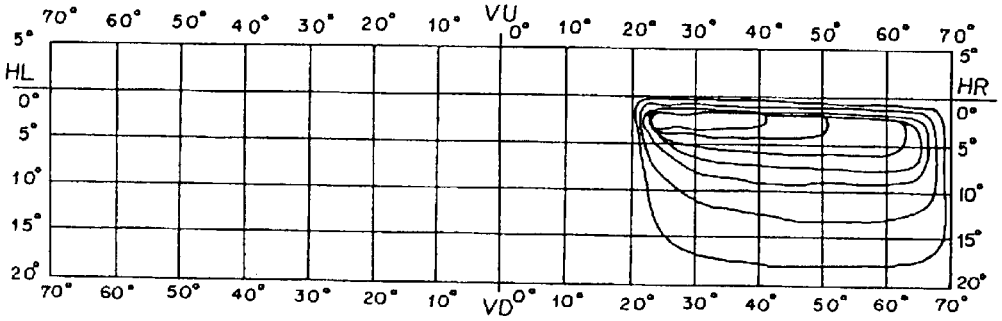
FIG. 8 is an image view which shows the right cornering luminous intensity distribution pattern irradiated on the screen.

A left sub-reflector 3L and a right sub-reflector 3R are built on the left and right of the main reflector 2 in the light axis ZF-ZB direction, respectively. Each of the left sub-reflector 3L and the right sub-reflector 3R is a fixed reflector and has a vertical wall-shape structure. As shown in FIGS. 5, 7 and 8, the left sub-reflector 3L and the right sub-reflector 3R obtain cornering luminous intensity distribution patterns on the right and left of the luminous intensity distribution patterns for a dipped beam formed by the main reflector 2, respectively.

Figure 2:
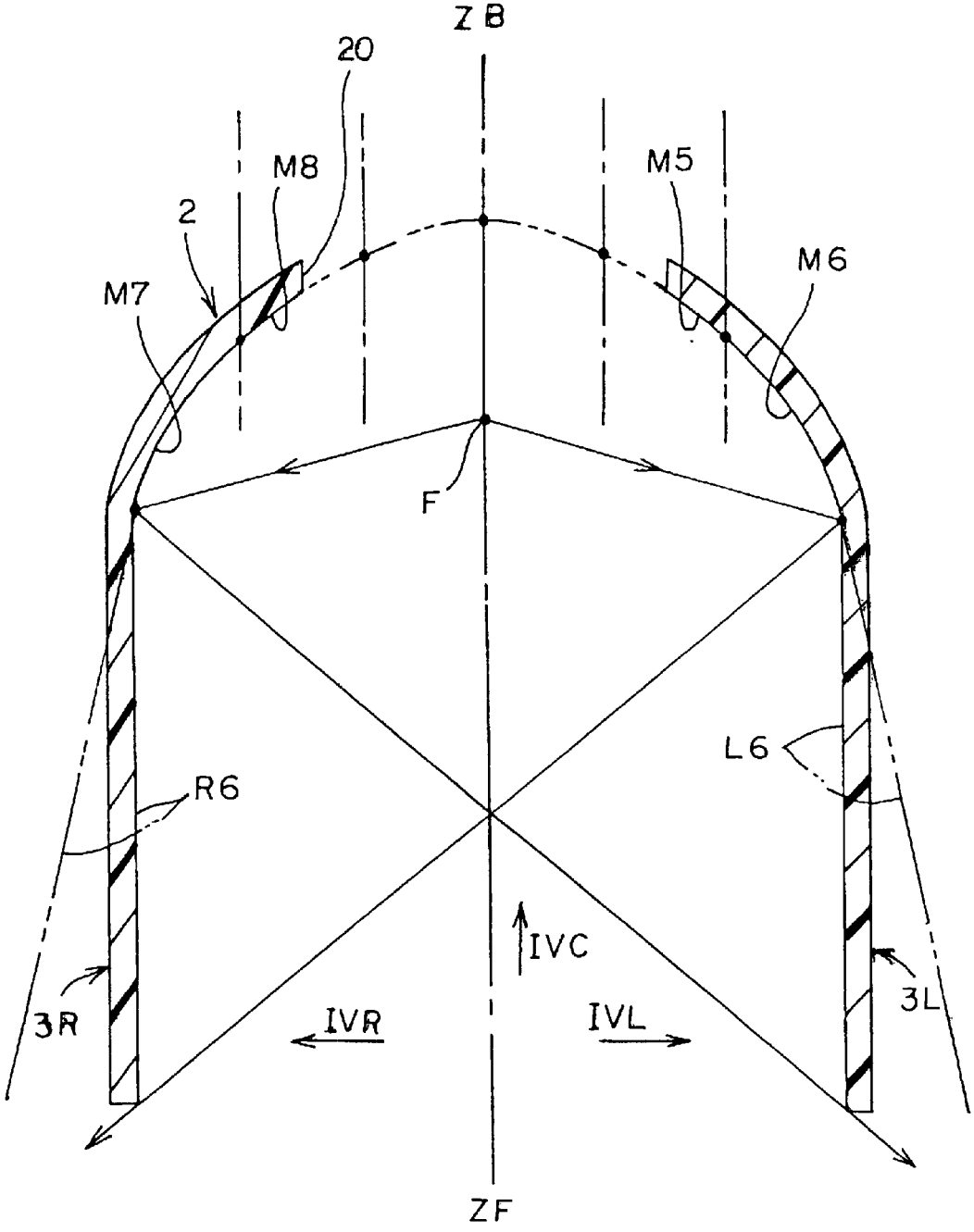
FIG. 2 is a cross-sectional view taken along line II—II of FIG. 1.

The left sub-reflector 3L and the right sub-reflector 3R have such depths that reflected light from one sub-reflector 3L or 3R is not blocked by the other sub-reflector 3R or 3L. That is, as shown in FIG. 2, the tip end of the other sub-reflector 3R or 3L is arranged backward relative to the reflected light (indicated by a solid-line arrow in FIG. 2) reflected by a portion of one sub-reflector 3L or 3R closest to the discharge lamp 1 (boundary between one sub-reflector 3L or 3R and the main reflector 2). While the sixth segments R6 and L6 from the top are explained in FIG. 2, the other segments are arranged in the same manner.

As shown in FIGS. 3 and 4, each of the left sub-reflector 3L and the right sub-reflector 3R has a structure of protruding forward more in upper and lower portions. In addition, as shown in FIGS. 1, 3 and 4, they consist of 13 vertically divided long sideways segments L1, L2, L3, L4, L5, L6, L7, L8, L9, L10, L11, L12 and L13, and R1, R2, R3, R4, R5, R6, R7, R8, R9, R10, R11, R12 and R13, respectively. Further, as shown in FIG. 5, the left sub-reflector 3L and the right sub-reflector 3R consist of reflection surfaces so that the lower portions of the cornering luminous intensity distribution patterns are diffused downward of those of the luminous intensity distribution patterns for a dipped beam obtained by the main reflector 2.

The discharge lamp 1, the main reflector 2, the left sub-reflector 3L and the right sub-reflector 3R are arranged in a lamp lens, i.e., so called lamp chamber which is defined by an outer cover (not shown) and a lamp housing (not shown). A headlamp is thus constituted. The headlamp is installed on each of the left and right sides on the front part of the vehicle.

Each of the main reflector 2, the left sub-reflector 3L and the right sub-reflector 3R is formed by combining free-form reflection surfaces in a complex manner. The reflection surfaces of the main reflector 2, the left sub-reflector 3L and the right sub-reflector 3R are formed by aluminum evaporation or silver coating.

The main reflector 2 mainly consists of 20 longitudinal segments (reflection surface blocks) U1 to U6, M1 to M8 and D1 to D6. The left sub-reflector 3L and the right sub-reflector 3R consist of 13 long sideways segments (reflection surface blocks) L1 to L13 and R1 to R13, respectively. As shown in the drawings, segment boundary lines are visible on the main reflector 2, the left sub-reflector 3L and the right sub-reflector 3R. However, if the segments are continuous (the segments are continuously formed), the segment boundary lines are sometimes invisible.

The details of the main reflector 2, the left sub-reflector 3L and the right sub-reflector 3R each of which consists of free-form surfaces are explained in, for example, "Mathematical Elements for Computer Graphics" (David F. Rogers and J Alan Adams) The main reflector 2, the left sub-reflector 3L and the right sub-reflector 3R will be explained briefly. The reflection surfaces of the main reflector 2, the left sub-reflector 3L and the right sub-reflector 3R are obtained by an ordinary equation (1). Equation (2) shows parametric functions of the ordinary equation (1). By assigning specific numeric values, e.g., parabolic points to parametric functions of equation (2), the concrete reflection surfaces of the main reflector 2, the left sub-reflector 3L and the right sub-reflector 3R can be obtained. [Equation 1]

[Equation 1]

$$P(u.v) = \sum_{j=0}^{m} \sum_{k=0}^{n} P_{j,k} N_{j,s}(u) N_{k,t}(v) \tag{1}$$

[Equation 2]

$$N_{j,s}(u) = \begin{cases} 1 & (\text{if } u_j \leqq u < u_{j+1}) \\ 0 & (\text{others}) \end{cases} \tag{2}$$

$$N_{j,s}(u) = \frac{u - u_j}{u_{j+s-1} - u_j} N_{j,s-1}(u) + \frac{u_{j+s} - u}{u_{j+s} - u_{j+1}} N_{j+1,s-1}(u)$$

$$N_{k\,t}(v) = \begin{cases} 1 & (\text{if } v_k \leqq v < v_{k+1}) \\ 0 & (\text{others}) \end{cases}$$

$$N_{k,t}(v) = \frac{v - v_k}{v_{k+t-1} - v_k} N_{k,t-1}(v) + \frac{v_{k+t} - v}{v_{k+t} - v_{k+1}} N_{k+1,t-1}(v)$$

To be strict, the main reflector 2, the left sub-reflector 3L and the right sub-reflector 3R do not have the same focus F. However, since differences in focal distance among a plurality of reflection surfaces are small, nearly the same focus is shared among the main reflector 2, the left sub-reflector 3L and the right sub-reflector 3R. Therefore, in this specification and drawings, this nearly the same focus will be referred to as a "pseudo-focus" (or simply "focus") F hereinafter. Likewise, to be strict, the main reflector 2, (the left sub-reflector 3L and the right sub-reflector 3R) do not have the same single light axis Z—Z. However, since differences in light axis among the reflection surfaces are small, nearly the same light axis is shared among the main reflector 2, the left sub-reflector 3L and the right sub-reflector 3R. Therefore, in this specification and drawings, this nearly same light axis will be referred to as a "pseudo-light axis" (or simply "light axis") hereinafter.

Desired luminous intensity distribution patterns can be obtained by the main reflector 2, the left sub-reflector 3L and the right sub-reflector 3R each consisting of free-form surfaces. Namely, the main reflector 2 obtains a predetermined luminous intensity distribution pattern for a dipped beam shown in FIG. 6. This luminous intensity distribution pattern is a luminous intensity distribution pattern for a dipped-beam that satisfies standards and the like. The left sub-reflector 3L and the right sub-reflector 3R obtain cornering luminous intensity distribution patterns shown in FIGS. 7 and 8, respectively.

FIG. 5 is an image view of a luminous intensity distribution pattern obtained by the headlamp in this embodiment and irradiated on a screen. This luminous intensity distribution pattern is formed by combining the left and right cornering luminous intensity distribution patterns shown in FIGS. 7 and 8, respectively with the luminous intensity distribution pattern for a dipped beam shown in FIG. 6.

Figure 6:
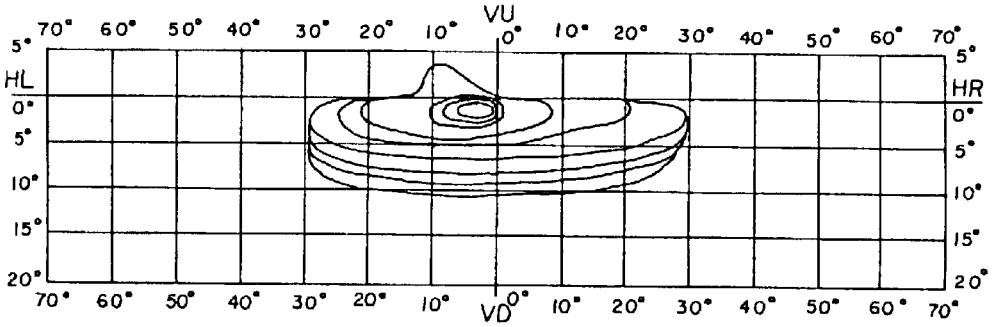
FIG. 6 is an image view which shows the luminous intensity distribution pattern for a dipped beam irradiated on the screen.

FIG. 6 is an image view of a luminous intensity distribution pattern obtained by the main reflector 2 in this embodiment and irradiated on the screen. This luminous intensity distribution pattern is a luminous intensity distribution pattern satisfying the standards and a luminous intensity distribution pattern for a dipped-beam. That is, this luminous intensity distribution pattern has the highest light intensity slightly downward of the horizontal line HL-HR and slightly leftward of the vertical line VU-VD, a cut line almost along the horizontal line HL-HR, and a triangle cut line slightly leftward of the vertical line VU-VD of the horizontal cut line. In this luminous intensity distribution pattern, a central curve indicates 30000 cd and the other curves indicate 20000 cd, 10000 cd, 5000 cd, 2500 cd, 1000 cd, 500 cd, 100 cd and 50 cd in the order of outward direction, respectively.

FIG. 7 is an image view of the luminous intensity distribution pattern obtained by the right sub-reflector 3R in this embodiment and irradiated on the screen. This luminous intensity distribution pattern is a left cornering luminous intensity distribution pattern. Namely, this pattern is diffused at about 20° to 68° toward the left side of the vertical line VU-VD and at about 0° to 18° downward of the horizontal line HL-HR. In addition, the light intensity of this luminous intensity distribution pattern is high near the horizontal line HL-HR and gradually lowers downward. As a result, if this cornering luminous intensity distribution pattern is actually irradiated on the road surface or the like, the brightness of the front of the road surface or the like (lower portion in FIG. 7) and that of distant portions of the road surface or the like (upper portion and portion near the horizontal line HL-HR in FIG. 7) are almost equal, thus showing that this pattern is an optimum cornering luminous intensity distribution pattern. In this luminous intensity distribution pattern, a central curve indicates 10000 cd and the other curves indicate 5000 cd, 2500 cd, 1000 cd, 500 cd, 100 cd and 50 cd in the order of outward direction, respectively.

FIG. 8 is an image view of the luminous intensity distribution pattern obtained by the left sub-reflector 3L in this embodiment and irradiated on the screen. This luminous intensity distribution pattern is a right cornering luminous intensity distribution pattern. Namely, this pattern is diffused at about 20° to 68° toward the right of the vertical line VU-VD and at about 0° to 18° downward of the horizontal line HL-HR. In addition, the light intensity of this luminous intensity distribution pattern is high near the horizontal line HL-HR and gradually lowers downward. As a result, if this diffusion type luminous intensity distribution pattern is actually irradiated on the road surface or the like, the brightness of the front of the road surface or the like (lower portion in FIG. 8) and that of the distant locations of the road surface or the like (upper portion and portion near the horizontal line HL-HR in FIG. 8) are almost equal, thus showing that this pattern is an optimum cornering luminous intensity distribution pattern. In this luminous intensity distribution pattern, a central curve indicates 10000 cd and the other curves indicate 5000 cd, 2500 cd, 1000 cd, 500 cd, 100 cd and 50 cd in the order of outward direction, respectively.

(Explanation of Luminous Intensity Distribution Patterns of Respective Segments in This Embodiment)

FIGS. 9 to 41 are explanatory views which show simplified luminous intensity distribution patterns of the respective segments obtained by computer simulation (luminous intensity distribution patterns each of which are a collection of small rectangular light source images (images of discharge arcs of the discharge lamp 1)).

Figure 9:
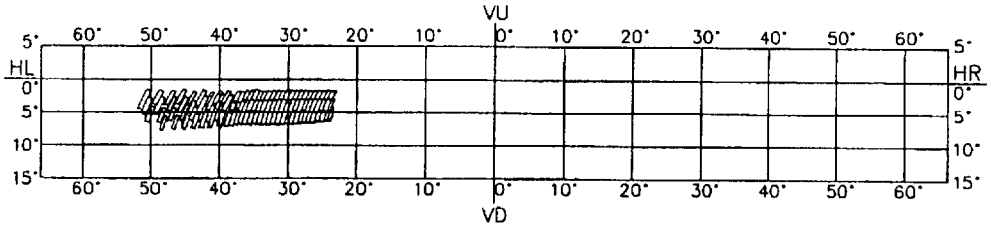
FIG. 9 is an explanatory view which shows a luminous intensity distribution pattern obtained by computer simulation and which shows the simplified luminous intensity distribution pattern of a segment R1 of the right sub-reflector.
Figure 10:
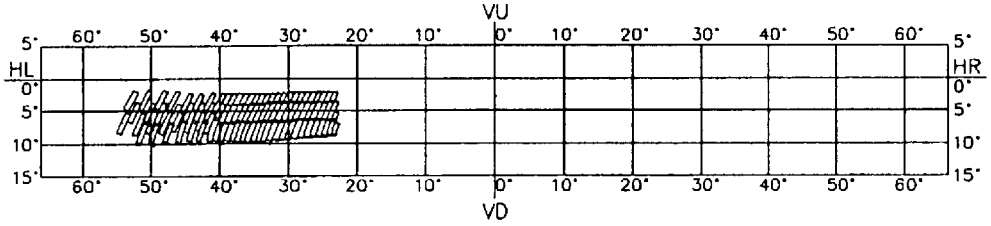
FIG. 10 is an explanatory view which shows a luminous intensity distribution pattern obtained by computer simulation and which shows the simplified luminous intensity distribution pattern of a segment R2 of the right sub-reflector.
Figure 11:
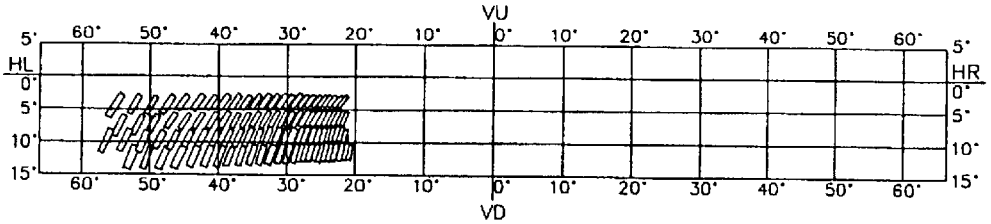
FIG. 11 is an explanatory view which shows a luminous intensity distribution pattern obtained by computer simulation and which shows the simplified luminous intensity distribution pattern of a segment R3 of the right sub-reflector.
Figure 12:
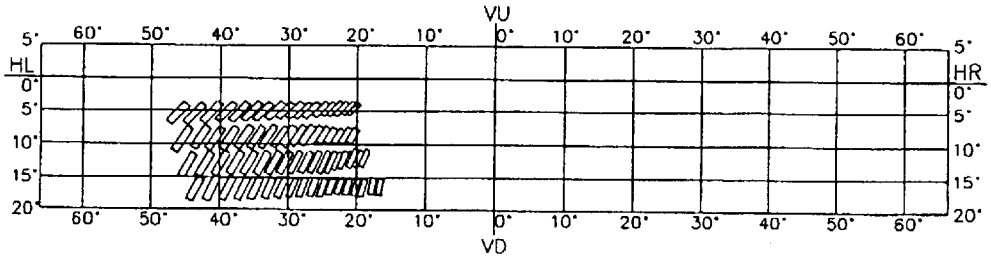
FIG. 12 is an explanatory view which shows a luminous intensity distribution pattern obtained by computer simulation and which shows the simplified luminous intensity distribution pattern of a segment R4 of the right sub-reflector.
Figure 13:
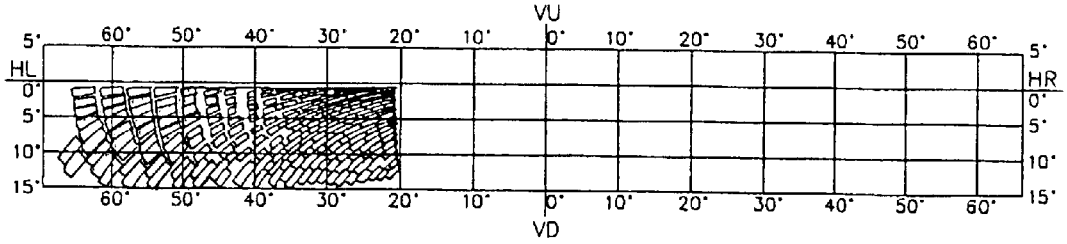
FIG. 13 is an explanatory view which shows a luminous intensity distribution pattern obtained by computer simulation and which shows the simplified luminous intensity distribution pattern of a segment R5 of the right sub-reflector.
Figure 14:
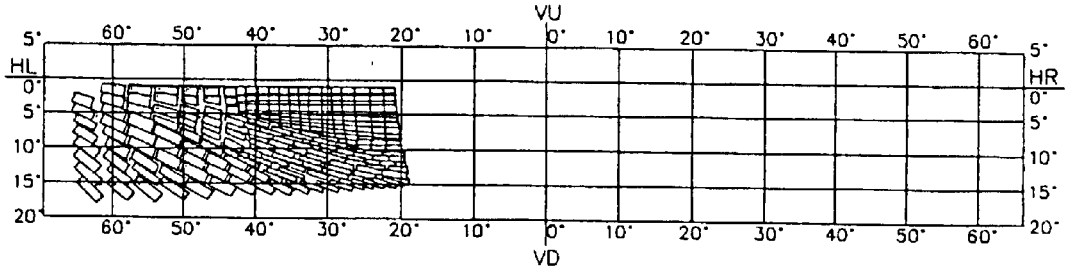
FIG. 14 is an explanatory view which shows a luminous intensity distribution pattern obtained by computer simulation and which shows the simplified luminous intensity distribution pattern of a segment R6 of the right sub-reflector.
Figure 15:
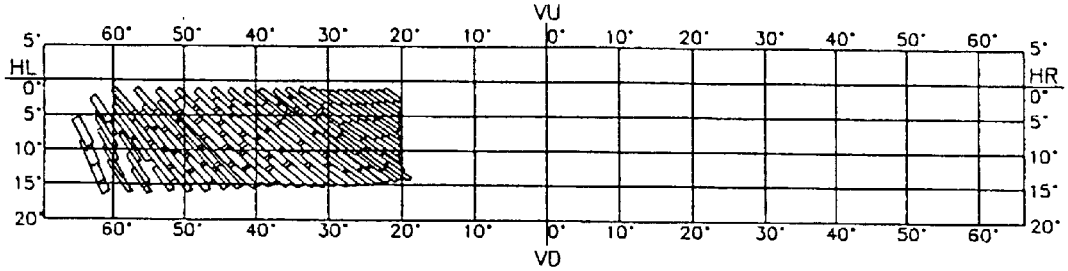
FIG. 15 is an explanatory view which shows a luminous intensity distribution pattern obtained by computer simulation and which shows the simplified luminous intensity distribution tern of a segment R7 of the right sub-reflector.
Figure 16:
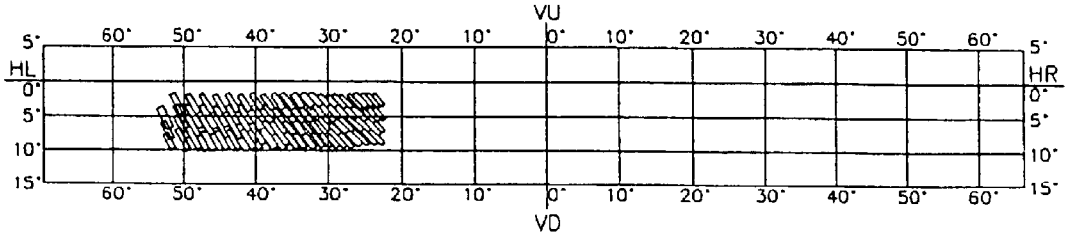
FIG. 16 is an explanatory view which shows a luminous intensity distribution pattern obtained by computer simulation and which shows the simplified luminous intensity distribution pattern of a segment R8 of the right sub-reflector.
Figure 17:
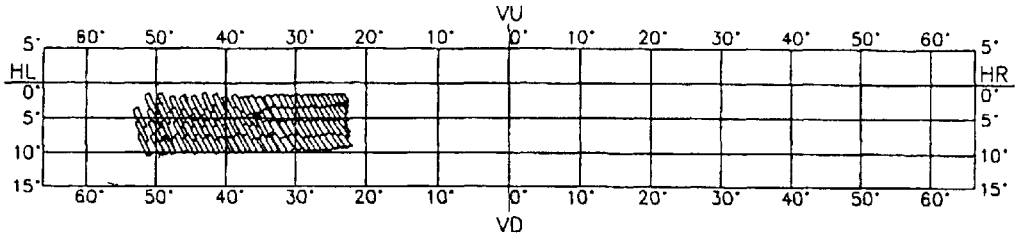
FIG. 17 is an explanatory view which shows a luminous intensity distribution pattern obtained by computer simulation and which shows the simplified luminous intensity distribution pattern of a segment R9 of the right sub-reflector.
Figure 18:
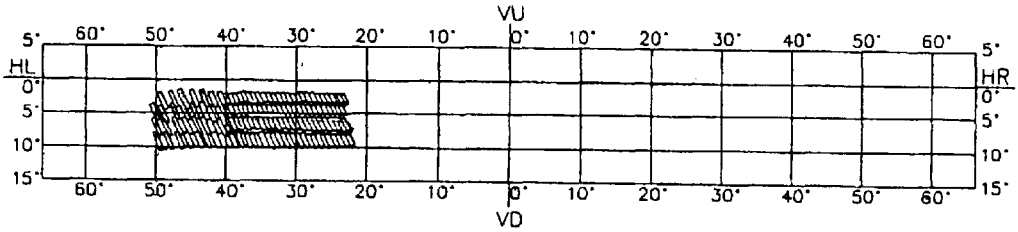
FIG. 18 is an explanatory view which shows a luminous intensity distribution pattern obtained by computer simulation and which shows the simplified luminous intensity distribution pattern of a segment R10 of the right sub-reflector.
Figure 19:
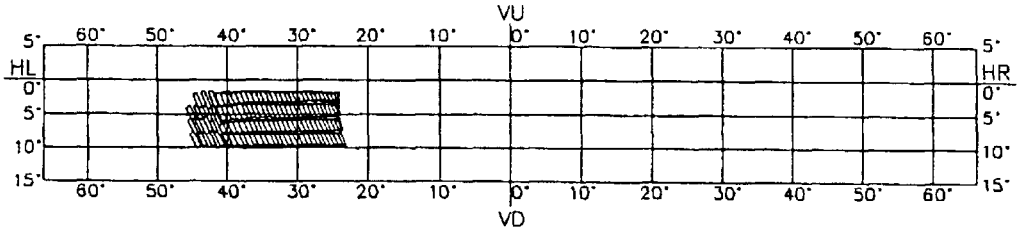
FIG. 19 is an explanatory view which shows a luminous intensity distribution pattern obtained by computer simulation and which shows the simplified luminous intensity distribution pattern of a segment R11 of the right sub-reflector.
Figure 20:
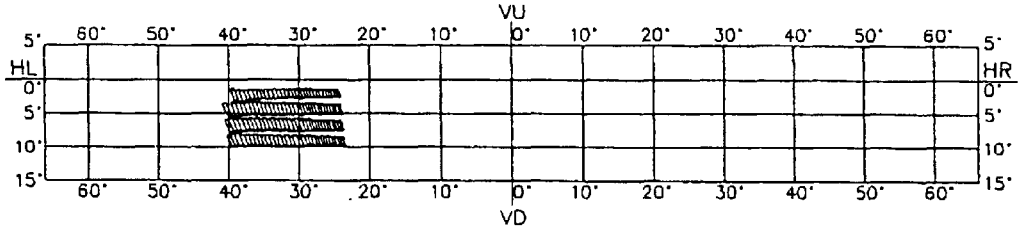
FIG. 20 is an explanatory view which shows a luminous intensity distribution pattern obtained by computer simulation and which shows the simplified luminous intensity distribution pattern of a segment R12 of the right sub-reflector.
Figure 21:
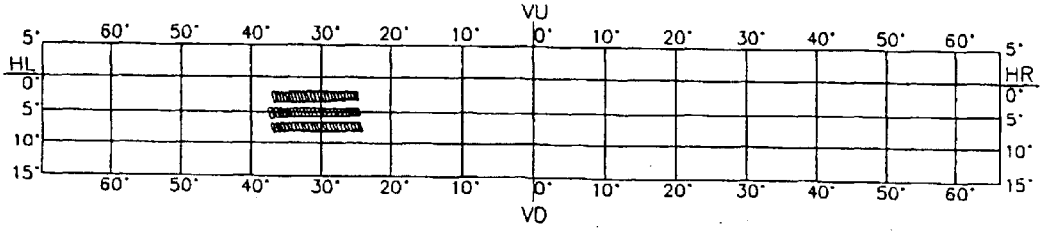
FIG. 21 is an explanatory view which shows a luminous intensity distribution pattern obtained by computer simulation and which shows the simplified luminous intensity distribution pattern of a segment R13 of the right sub-reflector.

FIG. 9 shows the luminous intensity distribution pattern of the first segment R1 of the right sub-reflector 3R from the top. Likewise, FIG. 10 shows the luminous intensity distribution pattern of the second segment R2 of the right sub-reflector 3R from the top. FIG. 11 shows the luminous intensity distribution pattern of the third segment R3 of the right sub-reflector 3R from the top. FIG. 12 shows the luminous intensity distribution pattern of the fourth segment R4 of the right sub-reflector 3R from the top. FIG. 13 shows the luminous intensity distribution pattern of the fifth segment R5 of the right sub-reflector 3R from the top. FIG. 14 shows the luminous intensity distribution pattern of the sixth segment R6 of the right sub-reflector 3R from the top. FIG. 15 shows the luminous intensity distribution pattern of the seventh segment R7 of the right sub-reflector 3R from the top. FIG. 16 shows the luminous intensity distribution pattern of the eighth segment R8 of the right sub-reflector 3R from the top. FIG. 17 shows the luminous intensity distribution pattern of the ninth segment R9 of the right sub-reflector 3R from the top. FIG. 18 shows the luminous intensity distribution pattern of the tenth segment R10 of the right sub-reflector 3R from the top. FIG. 19 shows the luminous intensity distribution pattern of the eleventh segment R11 of the right sub-reflector 3R from the top. FIG. 20 shows the luminous intensity distribution pattern of the twelfth segment R12 of the right sub-reflector 3R from the top. FIG. 21 shows the luminous intensity distribution pattern of the thirteenth segment R13 of the right sub-reflector 3R from the top. As shown in FIGS. 9 to 21, the luminous intensity distribution patterns obtained by the respective segments R1 to R13 of the right sub-reflector 3R are diffused leftward of the vertical line VU-VD and downward of the horizontal line HL-HR. It is noted that the luminous intensity distribution patterns of the respective segments L1 to L13 of the left sub-reflector 3L are reversed from left to right (horizontally symmetrical) of those of the respective segments R1 to R3 of the right sub-reflector 3R. Therefore, the luminous intensity distribution patterns of the respective segments L1 to L13 of the left sub-reflector 3L will not be either explained in this specification or shown in the drawings.

Figure 22:
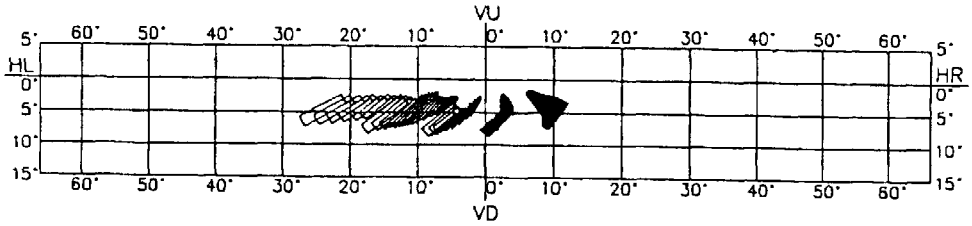
FIG. 22 is an explanatory view which shows a luminous intensity distribution pattern obtained by computer simulation and which shows the simplified luminous intensity distribution pattern of an upper segment U1 of the main reflector.
Figure 23:
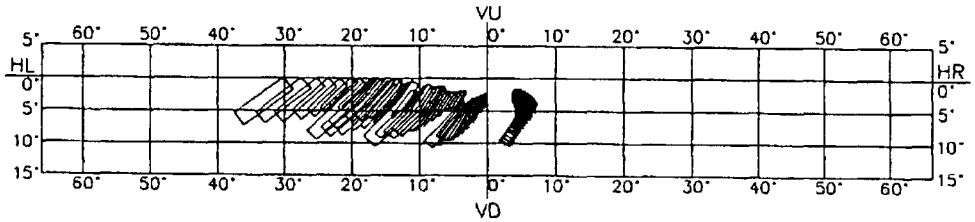
FIG. 23 is an explanatory view which shows a luminous intensity distribution pattern obtained by computer simulation and which shows the simplified luminous intensity distribution pattern of an upper segment U2 of the main reflector.
Figure 24:
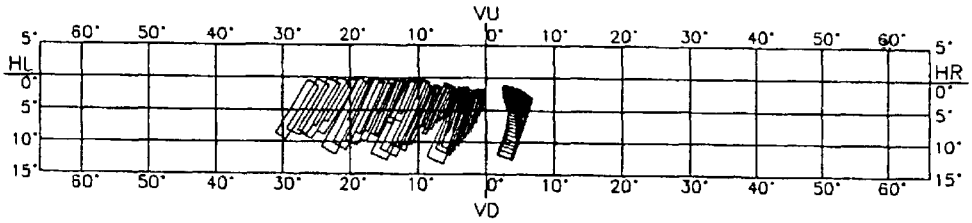
FIG. 24 is an explanatory view which shows a luminous intensity distribution pattern obtained by computer simulation and which shows the simplified luminous intensity distribution pattern of an upper segment U3 of the main reflector.
Figure 25:
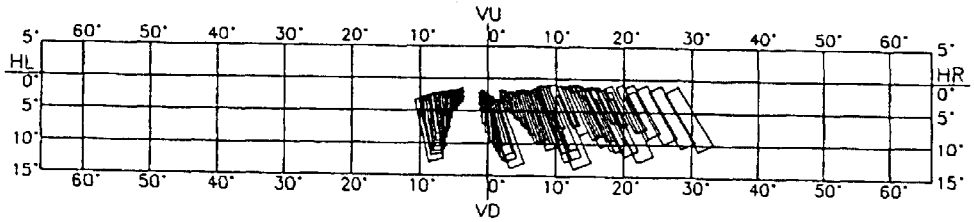
FIG. 25 is an explanatory view which shows a luminous intensity distribution pattern obtained by computer simulation and which shows the simplified luminous intensity distribution pattern of an upper segment U4 of the main reflector.
Figure 26:
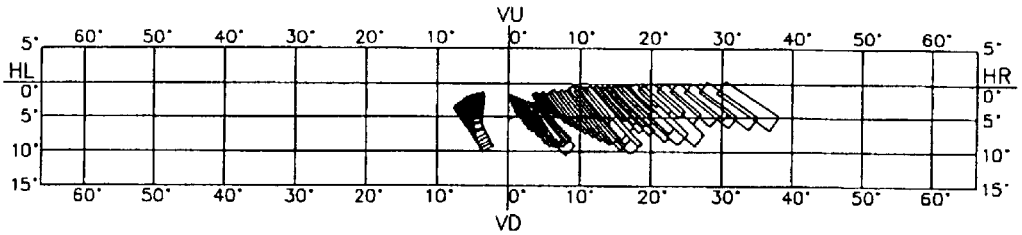
FIG. 26 is an explanatory view which shows a luminous intensity distribution pattern obtained by computer simulation and which shows the simplified luminous intensity distribution pattern of an upper segment U5 of the main reflector.
Figure 27:
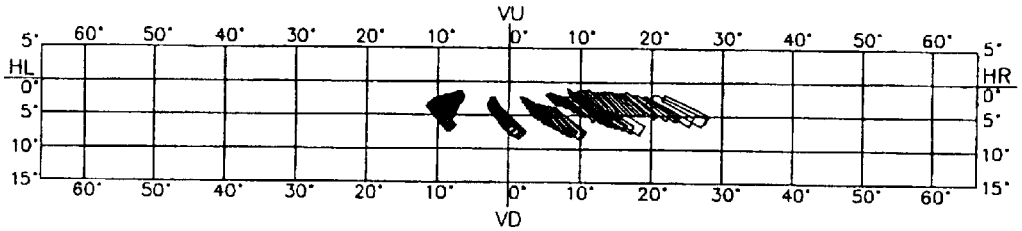
FIG. 27 is an explanatory view which shows a luminous intensity distribution pattern obtained by computer simulation and which shows the simplified luminous intensity distribution pattern of an upper segment U6 of the main reflector.

FIG. 22 shows the luminous intensity distribution pattern of the first upper segment U1 of the main reflector 2 from the right. Likewise, FIG. 23 shows the luminous intensity distribution pattern of the second upper segment U2 of the main reflector 2 from the right. FIG. 24 shows the luminous intensity distribution pattern of the third upper segment U3 of the main reflector 2 from the right. FIG. 25 shows the luminous intensity distribution pattern of the fourth upper segment U4 of the main reflector 2 from the right. FIG. 26 shows the luminous intensity distribution pattern of the fifth upper segment U5 of the main reflector 2 from the right. FIG. 27 shows the luminous intensity distribution pattern of the sixth upper segment U6 of the main reflector 2 from the right. As shown in FIGS. 22 to 27, the luminous intensity distribution patterns obtained by the respective upper segments U1 to U6 of the main reflector 2 include cut lines along the horizontal lines HL-HR, respectively.

Figure 28:
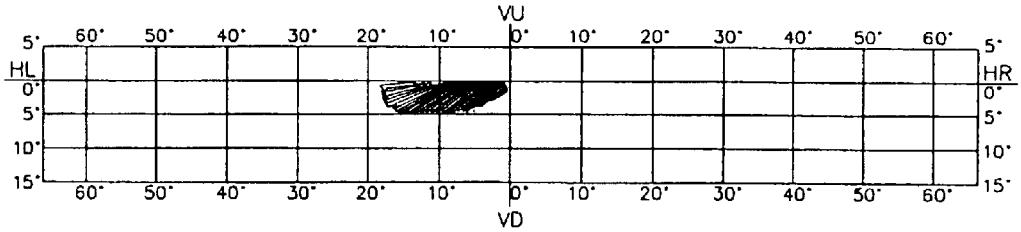
FIG. 28 is an explanatory view which shows a luminous intensity distribution pattern obtained by computer simulation and which shows the simplified luminous intensity distribution pattern of a middle segment M1 of the main reflector.
Figure 29:
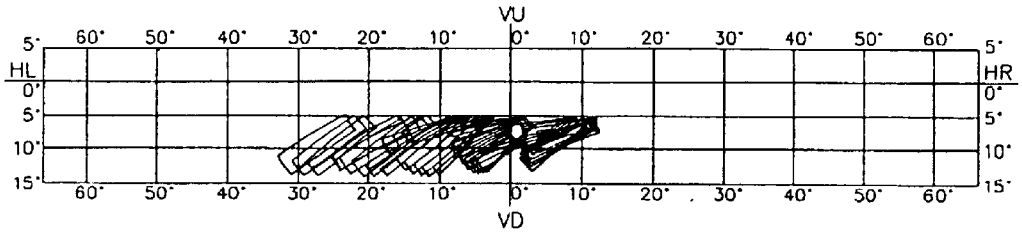
FIG. 29 is an explanatory view which shows a luminous intensity distribution pattern obtained by computer simulation and which shows the simplified luminous intensity distribution pattern of a middle segment M2 of the main reflector.
Figure 30:
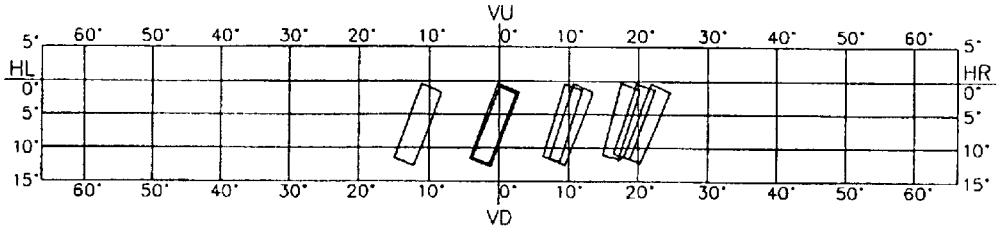
FIG. 30 is an explanatory view which shows a luminous intensity distribution pattern obtained by computer simulation and which shows the simplified luminous intensity distribution pattern of a middle segment M3 of the main reflector.
Figure 31:
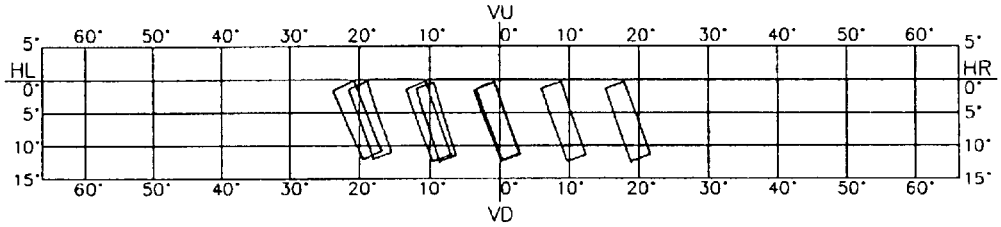
FIG. 31 is an explanatory view which shows a luminous intensity distribution pattern obtained by computer simulation and which shows the simplified luminous intensity distribution pattern of a middle segment M4 of the main reflector.
Figure 32:
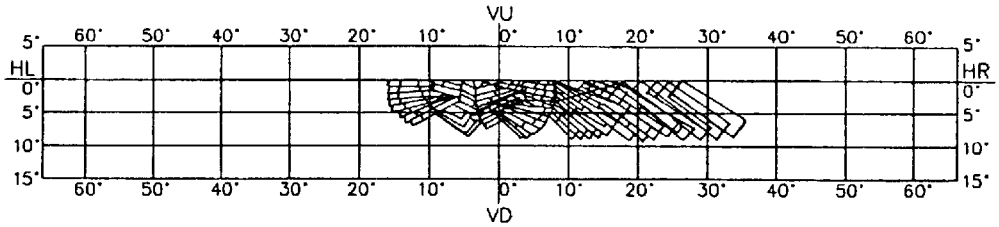
FIG. 32 is an explanatory view which shows a luminous intensity distribution pattern obtained by computer simulation and which shows the simplified luminous intensity distribution pattern of a middle segment M5 of the main reflector.
Figure 33:
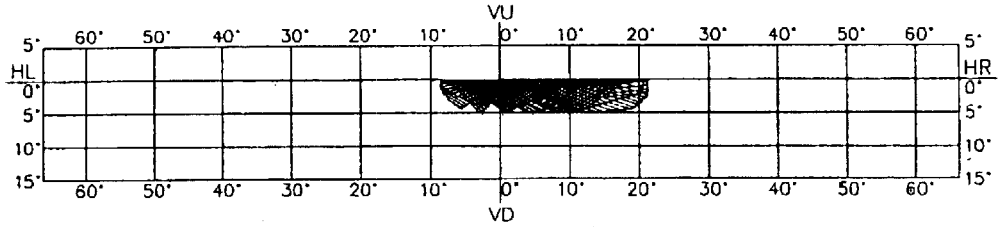
FIG. 33 is an explanatory view which shows a luminous intensity distribution pattern obtained by computer simulation and which shows the simplified luminous intensity distribution pattern of a middle segment M6 of the main reflector.
Figure 34:
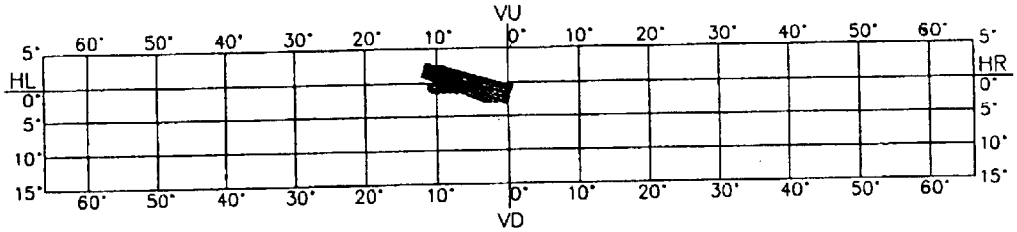
FIG. 34 is an explanatory view which shows a luminous intensity distribution pattern obtained by computer simulation and which shows the simplified luminous intensity distribution pattern of a middle segment M7 of the main reflector.
Figure 35:
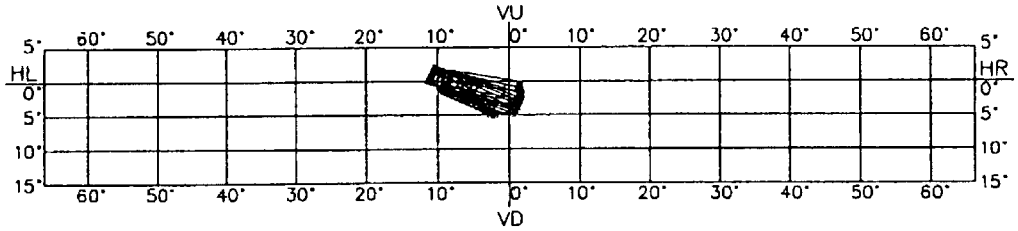
FIG. 35 is an explanatory view which shows a luminous intensity distribution pattern obtained by computer simulation and which shows the simplified luminous intensity distribution pattern of a middle segment M8 of the main reflector.

FIG. 28 shows the luminous intensity distribution pattern of the first upper middle segment M1 of the main reflector 2 from the right. Likewise, FIG. 29 shows the luminous intensity distribution pattern of the second upper middle segment M2 of the main reflector 2 from the right. FIG. 30 shows the luminous intensity distribution pattern of the third middle segment M3 of the main reflector 2 from the right. FIG. 31 shows the luminous intensity distribution pattern of the fourth middle segment M4 of the main reflector 2 from the right. FIG. 32 shows the luminous intensity distribution pattern of the fifth middle segment M5 of the main reflector 2 from the right. FIG. 33 shows the luminous intensity distribution pattern of the sixth middle segment M6 of the main reflector 2 from the right. FIG. 34 shows the luminous intensity distribution pattern of the first lower middle segment M7 of the main reflector 2 from the right. FIG. 35 shows the luminous intensity distribution pattern of the second lower middle segment M8 of the main reflector 2 from the right. As shown in FIGS. 28 to 35, the luminous intensity distribution patterns obtained by the respective middle segments M1 to M8 of the main reflector 2 have the highest light intensities, triangular cut lines and cut lines along the horizontal lines HL-HR, respectively.

Figure 36:
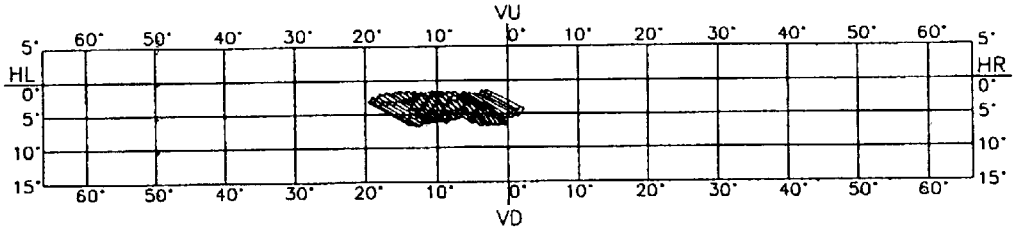
FIG. 36 is an explanatory view which shows a luminous intensity distribution pattern obtained by computer simulation and which shows the simplified luminous intensity distribution pattern of a lower segment D1 of the main reflector.
Figure 37:
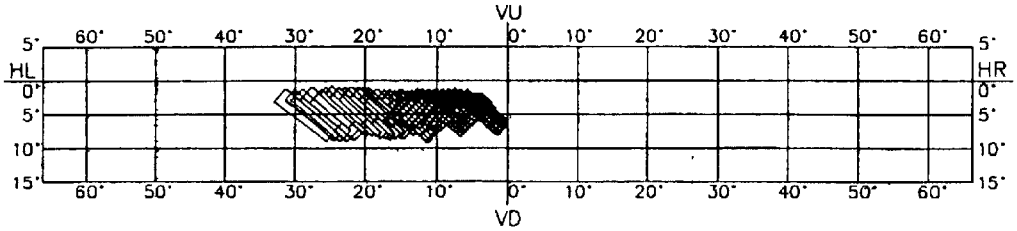
FIG. 37 is an explanatory view which shows a luminous intensity distribution pattern obtained by computer simulation and which shows the simplified luminous intensity distribution pattern of a lower segment D2 of the main reflector.
Figure 38:
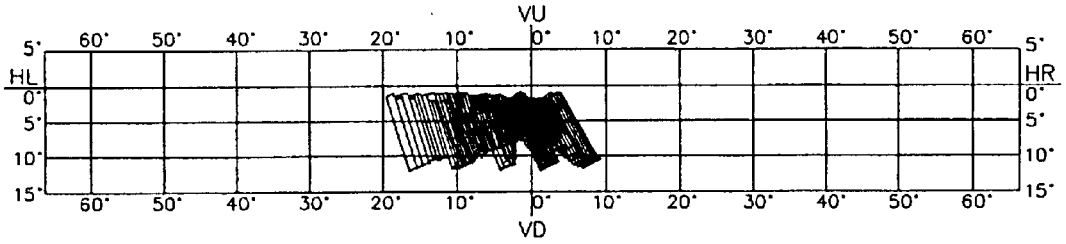
FIG. 38 is an explanatory view which shows a luminous intensity distribution pattern obtained by computer simulation and which shows the simplified luminous intensity distribution pattern of a lower segment D3 of the main reflector.
Figure 39:
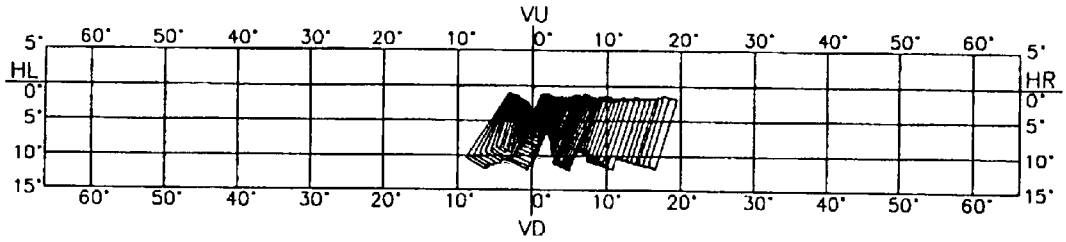
FIG. 39 is an explanatory view which shows a luminous intensity distribution pattern obtained by computer simulation and which shows the simplified luminous intensity distribution pattern of a lower segment D4 of the main reflector.
Figure 40:
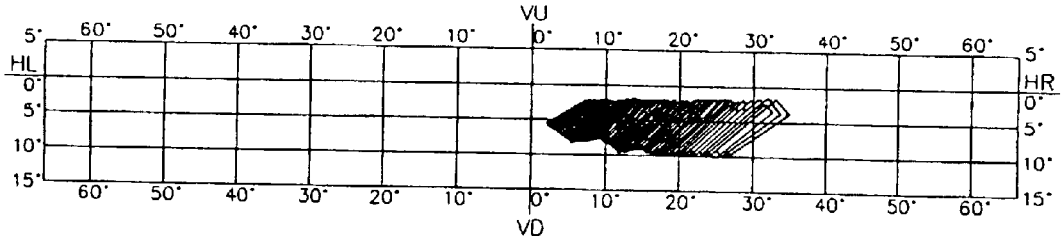
FIG. 40 is an explanatory view which shows a luminous intensity distribution pattern obtained by computer simulation and which shows the simplified luminous intensity distribution pattern of a lower segment D5 of the main reflector.
Figure 41:
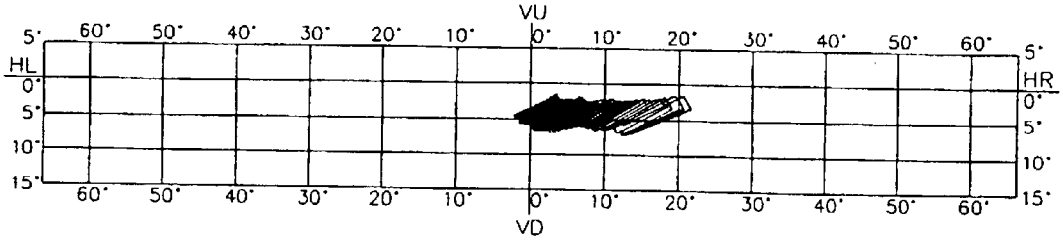
FIG. 41 is an explanatory view which shows a luminous intensity distribution pattern obtained by computer simulation and which shows the simplified luminous intensity distribution pattern of a lower segment D6 of the main reflector.

FIG. 36 shows the luminous intensity distribution pattern of the first lower segment D1 of the main reflector 2 from the right. Likewise, FIG. 37 shows the luminous intensity distribution pattern of the second lower segment D2 of the main reflector 2 from the right. FIG. 38 shows the luminous intensity distribution pattern of the third lower segment D3 of the main reflector 2 from the right. FIG. 39 shows the luminous intensity distribution pattern of the fourth lower segment D4 of the main reflector 2 from the right. FIG. 40 shows the luminous intensity distribution pattern of the fifth lower segment D5 of the main reflector 2 from the right. FIG. 41 shows the luminous intensity distribution pattern of the sixth lower segment D6 of the main reflector 2 from the right. As shown in FIGS. 36 to 41, the luminous intensity distribution patterns obtained by the respective lower segments D1 to D6 of the main reflector 2 include cut lines along the horizontal line HL-HR, respectively. In addition, the luminous intensity distribution patterns obtained by the respective lower segments D1 to D6 of the main reflector 2 are included in the luminous intensity distribution patterns obtained by the respective upper and middle segments U1 to U6 and M1 to M8 of the main reflector 2.

As explained above, according to the headlamp in this embodiment, if the discharge lamp 1 is turned on, the light from the discharge lamp 1 is reflected by the main reflector 2 and the luminous intensity distribution pattern for a dipped beam having the highest light intensity is obtained. The light from the discharge lamp 1 is reflected by the left sub-reflector 3L and the right sub-reflector 3R and the cornering luminous intensity distribution patterns are obtained, respectively. The cornering luminous intensity distribution patterns are combined with this dipped-beam luminous intensity distribution pattern on the left and right, and the combined pattern is irradiated externally. Further, according to the headlamp in this embodiment, the left and right sub-reflectors 3L and 3R are built on the left and right of the main reflector 2, respectively. Therefore, even if one of the headlamps installed respectively on the left and right sides of a vehicle fails, no large missing part of the luminous intensity distribution pattern is produced, though light intensity lowers. The total luminous intensity distribution pattern can be thereby maintained.

As explained so far, according to the headlamp in this embodiment, the left sub-reflector 3L and the right sub-reflector 3R are provided almost parallel to the light axis ZF-ZB on the left and right of the longitudinal main reflector 2, respectively. It is, therefore, possible to make the headlamp longitudinally compact if viewed from the front.

According to the headlamp in this embodiment, the sub-reflectors 3L and 3R are provided longitudinally, i.e., vertically elongated by making the headlamp compact longitudinally if viewed from the front. Therefore, the cornering luminous intensity distribution patterns diffused downward, i.e., luminous intensity distribution patterns illuminating the front road surface in the vehicle traveling direction are obtained. Besides, the left sub-reflector 3L and the right sub-reflector 3R are closer to the discharge lamp 1, making it possible to obtain better cornering luminous intensity distribution patterns.

According to the headlamp in this embodiment, the upper and lower portions of the main reflector 2 are protruded forward. It is, therefore, possible to effectively reflect the light from the discharge lamp 1. As a result, even if the main reflector 2 is made compact, the headlamp in this embodiment hardly wastes the light from the discharge lamp 1 but can make the fullest, effective use of the light from the discharge lamp 1.

According to the headlamp in this embodiment, the left sub-reflector 3L and the right sub-reflector 3R are fixed to the compact main reflector 2. Therefore, it is possible to arrange the left sub-reflector 3L and the right sub-reflector 3R within a compact range. According to the headlamp in this embodiment, it is thereby possible to make the entire headlamp compact longitudinally and to increase the degree of freedom to design a unique headlamp.

According to the headlamp in this embodiment, although the left sub-reflector 3L and the right sub-reflector 3R are built on the left and right of the main reflector 2, respectively, reflected light from one of the sub-reflectors 3L and 3R is not blocked by the other sub-reflector 3R or 3L. It is, therefore, possible to make effective use of the reflected light from the left sub-reflector 3L and the right sub-reflector 3R without wasting it.

According to the headlamp in this embodiment, since the discharge lamp 1 is used as a light source, it is possible to obtain more sufficient light quantity and light intensity. Besides, according to the headlamp in this embodiment, the reflection surfaces of the longitudinal main reflector 2 are constituted so that the light axis ZF-ZB and the discharge lamp 1 are located almost at the center of the longitudinal main reflector 2 and the luminous intensity distribution patterns obtained by the lower segments D1 to D6 of this longitudinal main reflector 2 are included in those obtained by the upper segments U1 to U6 and the middle segments M1 to M8. As a result, according to the headlamp in this embodiment, even if residues are produced in the discharge lamp 1 with the passage of time and the light that the residues pass differ in color from the light that the residues do not pass, a small quantity of light that the residues pass is included in the most part of the light that the residues do not pass. Therefore, the luminous intensity distribution pattern is hardly influenced by the colors of the light that the residues pass.

According to the headlamp in this embodiment, the main reflector 2 mainly consists of a plurality of longitudinal segments U1 to U6, M1 to M8 and D1 to D6 divided laterally. Therefore, the luminous intensity distribution patterns of the respective segments shown in FIGS. 22 to 41 are obtained. By combining these luminous intensity distribution patterns, it is possible to ensure obtaining the luminous intensity distribution pattern for a dipped beam which has the highest light intensity, the triangular cut line and the cut line along the horizontal line HL-HR shown in FIG. 6. Besides, the luminous intensity distribution pattern for a dipped beam is easy to design and the degree of freedom for the design of the luminous intensity distribution pattern for a dipped beam increases.

According to the headlamp in this embodiment, the left sub-reflector 3L and the right sub-reflector 3R consist of a plurality of long sideways segments L1 to L13 and R1 to R13 (in the direction of the light axis ZF-ZB) divided vertically, respectively. As a result, according to the headlamp in this embodiment, even if the left sub-reflector 3L and the right sub-reflector 3R are built on the left and right of the main reflector 2 in the direction of the light axis ZF-ZB, respectively, it is possible to pull out the molding dies of the main reflector 2, the left sub-reflector 3L and the right sub-reflector 3R in the light axis direction without using slide dies.

According to the headlamp in this embodiment, the left sub-reflector 3L and the right sub-reflector 3R are gradually protruded forward more in upper and lower portions. As a result, the headlamp in this embodiment can make more effective use of the light from the discharge lamp 1 in the forward protruded portions of the left sub-reflector 3L and the right sub-reflector 3R without wasting it.

According to the headlamp in this embodiment, the left sub-reflector 3L and the right sub-reflector 3R have terraced (Fresnel) shape vertically divided into a plurality of segments if viewed from the front. As a result, according to the headlamp in this embodiment, it is possible to greatly narrow the distance between the left and right sub-reflectors 3L and 3R viewed from the front, compared with the distance between left and right sub-reflectors each of which is not divided vertically and has a smooth circular arc shape. It is, therefore, possible to contribute to making the headlamp compact and to make effective use of the light from the discharge lamp 1.

According to the headlamp in this embodiment, each of the left sub-reflector 3L and the right sub-reflector 3R consists of the reflection surfaces to allow the lower portions of the cornering luminous intensity distribution patterns to be diffused downward more than those of the luminous intensity distribution patterns for a dipped beam obtained by the main reflector 2. As a result, the headlamp in this embodiment obtains the cornering luminous intensity distribution patterns extended in a wide range downward. Therefore, the headlamp can illuminate the front side on the road surface or the like and obtain optimum cornering lamp luminous intensity distribution patterns.

In this embodiment, the main reflector 2 has a longitudinal structure and the light axis ZF-ZB and the discharge lamp 1 are located almost at the center of the main reflector 2. Alternatively, according to this invention, if the light source is the discharge lamp 1, the main reflector may have the upper half structure of that shown in the drawings. Namely, the light axis ZF-ZB and the discharge lamp 1 may be located below the main reflector 2 of the longitudinal structure. In that case, the discharge lamp 1 is used as the light source. Therefore, even if the main reflector has the upper half longitudinal structure, sufficient light quantity and light intensity can be obtained. In addition, since the main reflector corresponds to the longitudinal upper half of that shown in the drawings, it is possible to make the headlamp compact.

In this embodiment, the main reflector 2 has a structure of an almost rectangularly longitudinal shape. Alternatively, this invention may have a main reflector of a shape other than the rectangular shape, e.g., a streamline shape (a drop shape).

Further, in this embodiment, the discharge lamp 1 is used as the light source. Alternatively, this invention may have a light source other than the discharge lamp 1, e.g., a halogen lamp or an incandescent lamp. In that case, it is possible to ensure sufficient light quantity and light intensity by employing the main reflector 2 shown in the drawings.

In this embodiment, since the discharge lamp 1 is used as the light source, the portions that form the highest light intensity in the main reflector 2 are lateral portions in the horizontal direction of the discharge lamp 1. In this embodiment, they correspond to the middle segments M1, M7 and M8. If the light source other than the discharge lamp 1, e.g., a C6 type light source is used, the portions that form the highest light intensity in the main reflector are located at an angle to the C6 type light source.

In this embodiment, the left sub-reflector 3L and the right sub-reflector 3R are built on the left and right of the main reflector 2, respectively. Alternatively, they may be provided separately on the left and right of the main reflector 2. In that case, if the headlamp having the sub-reflector built on the left of the main reflector is installed on the right side of a vehicle and the headlamp having the sub-reflector built on the right of the main reflector is installed on the left side of the vehicle, diffusion type luminous intensity distribution patterns are combined on the right and left of a predetermined luminous intensity distribution pattern for a dipped beam, respectively as a whole.

In this embodiment, the left sub-reflector 3L and the right sub-reflector 3R each of which are vertically divided have terraced shapes if viewed from the front, respectively. Alternatively, according to this invention, the sub-reflectors may not be terraced but connected to each other by one line.

In this embodiment, the left sub-reflector 3L and the right sub-reflector 3R are gradually protruded forward more in upper and lower portions, respectively. Alternatively, this invention may have sub-reflectors gradually protruded forward more in upper portions, sub-reflectors gradually protruded forward more in lower portions, sub-reflectors having almost vertical front ends or the like, respectively.

In this embodiment, the luminous intensity distribution pattern obtained by the main reflector 2 is for a dipped beam. Alternatively, according to this invention, the luminous intensity distribution pattern obtained by the main reflector 2 may be the luminous intensity distribution pattern other than that for a dipped beam. For example, the luminous intensity distribution pattern may be for traveling.

Furthermore, in this embodiment, the sub-reflectors 3L and 3R are built almost parallel to the light axis ZF-ZB. As indicated by a two-dot chain line shown in FIG. 2, the sub-reflectors 3L and 3R may be built so as to gradually open outward in a forward direction. In that case, it is possible to form diffusion type luminous intensity distribution patterns on the left and right of a predetermined luminous intensity distribution pattern, respectively and to distribute the light from the sub-reflectors to close to the center of the predetermined luminous intensity distribution pattern. In this way, by adjusting angles for providing the sub-reflectors 3L and 3R, it is possible to arbitrarily control the distribution of the light from the sub-reflectors 3L and 3R. That is, it is possible to control the portions having high light intensity to be located at arbitrary positions, in arbitrary sizes and arbitrary shapes in the luminous intensity distribution patterns, respectively.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

This application claims priority from Japanese Patent Application 2001-310758, filed Oct. 5, 2001, which is incorporated herein by reference in its entirety.

What is claimed is:

1. A headlamp which comprises a light source, and a reflector obtained by combining free-form reflection surfaces in a complex manner, wherein if the light source is turned on, light from the light source is reflected by the reflector to thereby obtain a predetermined luminous intensity distribution pattern and a predetermined lateral diffusion type luminous intensity distribution pattern, and wherein the reflector comprises a main reflector which has a light axis and obtains the predetermined luminous intensity distribution pattern, and a sub-reflector which obtains the predetermined diffusion type luminous intensity distribution pattern, the light source is arranged on the light axis, the main reflector has a longitudinal structure which has such a width near the light axis as to be able to obtain a highest light intensity and such a height as to be able to obtain the predetermined luminous intensity distribution pattern, if viewed from the front, and the sub-reflector is built on left or right of the main reflector and has a vertical wall structure which obtains the predetermined diffusion type luminous intensity distribution pattern on the left or right of the predetermined luminous intensity distribution pattern.

2. The headlamp according to claim 1, wherein the light axis and the light source are located almost in a central portion of the main reflector, and the main reflector has a structure in which upper and lower portions relative to the light axis and the light source protrude forward.

3. The headlamp according to claim 1, wherein the light axis and the light source are located almost in a lower portion of the main reflector, and the main reflector has a structure in which an upper portion relative to the light axis and the light source protrudes forward.

4. The headlamp according to claim 1, wherein the main reflector mainly comprises a plurality of longitudinal segments which are laterally divided.

5. The headlamp according to claim 1, wherein the light source is a discharge lamp, the light axis and the discharge lamp are located almost in a lower portion of the main reflector, and the main reflector has a longitudinal structure from an upper portion to the lower portion in which the light axis and the discharge lamp are provided, if viewed from the front.

6. The headlamp according to claim 1, wherein the light source is a discharge lamp, the light axis and the discharge lamp are located almost in a central portion of the main reflector, the main reflector has a longitudinal structure from an upper portion, through the central portion in which the light axis and the discharge lamp are provided, to a lower portion if viewed from the front, and the reflection surfaces of the main reflector consist of reflection surfaces which enable the luminous intensity distribution pattern obtained on the reflection surfaces ranging from the central portion to the lower portion to be included in the luminous intensity distribution pattern obtained on the reflection surfaces ranging from the upper portion to the central portion.

7. The headlamp according to claim 1, wherein the sub-reflector has a structure of gradually protruding forward from a central portion, in which the light source is located, toward upper and lower portions.

8. The headlamp according to claim 1, wherein the light source is located almost in a lower portion of the main reflector, and the sub-reflector has a structure of gradually protruding forward from the lower portion in which the light source is located toward an upper portion.

9. The headlamp according to claim 1, wherein the sub-reflector comprises a plurality of long sideways segments which are vertically divided.

10. The headlamp according to claim 1, wherein the reflection surfaces of the sub-reflector consist of reflection surfaces which enable a lower portion of the predetermined diffusion type luminous intensity distribution pattern to be diffused downward of a lower portion of the predetermined luminous intensity distribution pattern obtained by the main reflector, and the sub-reflector is built on each of right and left of the main reflector, obtains the diffusion type luminous intensity distribution pattern on each of right and left of the predetermined luminous intensity distribution pattern, and has a vertical wall shape.

11. A headlamp which comprises a light source, and a reflector obtained by combining free-form reflection surfaces in a complex manner, wherein if the light source is turned on, light from the light source is reflected by the reflector to thereby obtain a predetermined luminous intensity distribution pattern and predetermined left and right diffusion type luminous intensity distribution pattern, and wherein the reflector comprises a main reflector which has a light axis and obtains the predetermined luminous intensity distribution pattern, and sub-reflectors which obtain the predetermined diffusion type luminous intensity distribution pattern, respectively, the light source is arranged on the light axis, the main reflector has a longitudinal structure which has such a width near the light axis as to be able to obtain a highest light intensity and such a height as to be able to obtain the predetermined luminous intensity distribution pattern, if viewed from the front, the sub-reflectors are built on left and right of the main reflector and have vertical wall structures which obtain the predetermined diffusion type luminous intensity distribution patterns on the left and right of the predetermined luminous intensity distribution pattern, respectively, and the left and right sub-reflectors have such depths as to prevent the reflected light from being blocked by the other sub-reflector.

12. The headlamp according to claim 11, wherein the light axis and the light source are located almost in a central portion of the main reflector, and the main reflector has a structure in which upper and lower portions relative to the light axis and the light source protrude forward.

13. The headlamp according to claim 11, wherein the light axis and the light source are located almost in a lower portion of the main reflector, and the main reflector has a structure in which an upper portion relative to the light axis and the light source protrudes forward.

14. The headlamp according to claim 11, wherein the main reflector mainly comprises a plurality of longitudinal segments which are laterally divided.

15. The headlamp according to claim 11, wherein the light source is a discharge lamp, the light axis and the discharge lamp are located almost in a lower portion of the main reflector, and the main reflector has a longitudinal structure from an upper portion to the lower portion in which the light axis and the discharge lamp are provided, if viewed from the front.

16. The headlamp according to claim 11, wherein the light source is a discharge lamp, the light axis and the discharge lamp are located almost in a central portion of the main reflector, the main reflector has a longitudinal structure from an upper portion, through the central portion in which the light axis and the discharge lamp are provided, to a lower portion if viewed from the front, and the reflection surfaces of the main reflector consist of reflection surfaces which enable the luminous intensity distribution pattern obtained on the reflection surfaces ranging from the central portion to the lower portion to be included in the luminous intensity distribution pattern obtained on the reflection surfaces ranging from the upper portion to the central portion.

17. The headlamp according to claim 11, wherein the light source is located almost in a central portion of the main reflector, the left sub-reflector and the right sub-reflector have structures of gradually protruding forward from a central portion, in which the light source is located, toward upper and lower portions, respectively.

18. The headlamp according to claim 11, wherein the light source is located almost in a lower portion of the main reflector, and the left sub-reflector and the right sub-reflector have structures of gradually protruding forward from the lower portion in which the light source is located toward an upper portion, respectively.

19. The headlamp according to claim 11, wherein each of the left sub-reflector and the right sub-reflector comprises a plurality of long sideways segments which are vertically divided.

20. The headlamp according to claim 11, wherein the reflection surfaces of the left sub-reflector and the right sub-reflector consist of reflection surfaces which enable lower portions of the predetermined diffusion type luminous intensity distribution patterns to be diffused downward of a lower portion of the predetermined luminous intensity distribution pattern obtained by the main reflector.

21. A headlamp which comprises a light source, and a reflector obtained by combining free-form reflection surfaces in a complex manner, wherein if the light source is turned on, light from the light source is reflected by the reflector to thereby obtain a dipped-beam luminous intensity distribution pattern and cornering luminous intensity distribution patterns located on left and right of the dipped-beam luminous intensity distribution pattern, respectively, and wherein the reflector comprises a main reflector which has a light axis and obtains the dipped-beam luminous intensity distribution pattern, and sub-reflectors which obtain the cornering luminous intensity distribution patterns located on the left and right of the dipped-beam luminous intensity distribution pattern, respectively, the light source is a discharge lamp and arranged on the light axis, the light axis and the discharge lamp located almost in a central portion of the main reflector, the main reflector has a longitudinal structure which has such a width near the light axis as to be able to obtain a highest light intensity and such a height as to be able to obtain the dipped-beam luminous intensity distribution pattern, if viewed from the front, the main reflector has a structure in which upper and lower portions relative to the light axis and the discharge lamp protrude forward, the main reflector mainly comprises a plurality of longitudinal segments which are divided laterally, the reflection surfaces of the main reflector consist of reflection surfaces which enable the luminous intensity distribution pattern obtained on the reflection surfaces ranging from a central portion to the lower portion to be included in the luminous intensity distribution pattern obtained on the reflection surfaces ranging from the upper portion to the central portion, the sub-reflectors are built on the left and right of the main reflector and have vertical wall structures which obtain the cornering luminous intensity distribution patterns on lower left and lower right of the dipped-beam luminous intensity distribution pattern, respectively, the left sub-reflector and the right sub-reflector have such depths as to prevent the reflected light from one of the left and right sub-reflectors from being blocked by the other sub-reflector, each of the left sub-reflector and the right sub-reflector has a structure gradually protruding forward from the central portion in which the light source is located, toward the upper and lower portions, each of the left sub-reflector and the right sub-reflector comprises a plurality of long sideways segments which are divided vertically, and the reflection surfaces of the left sub-reflector and the right sub-reflector consist of reflection surfaces which enable lower portions of the cornering luminous intensity distribution patterns to be diffused downward of the lower portion of the dipped-beam luminous intensity distribution pattern obtained by the main reflector.

* * * * *